United States Patent [19]

Billingsley

[11] Patent Number: 4,958,987

[45] Date of Patent: Sep. 25, 1990

[54] MATERIALS HANDLING FAN IMPELLER

[75] Inventor: John G. S. Billingsley, Newark, Del.

[73] Assignee: Precision Cutters, Inc., Phillipsburg, N.J.

[21] Appl. No.: 382,298

[22] Filed: Jul. 20, 1989

[51] Int. Cl.[5] ..... F01D 5/14

[52] U.S. Cl. ..... 416/213 A; 416/182; 29/889.4; 241/46.17

[58] Field of Search ..... 416/185, 183, 213 A, 416/186 R, 188, 182, 213 R; 415/912, 915, 203, 206; 29/889.4; 241/46.17; 366/343, 317

[56] References Cited

U.S. PATENT DOCUMENTS

| | | | |
|---|---|---|---|
| 1,427,391 | 8/1922 | Johns | 416/185 |
| 1,849,557 | 3/1932 | Stelzer | 29/156.8 CF |
| 1,953,064 | 4/1934 | Dowson | 416/186 R |
| 1,959,703 | 5/1934 | Birmann | 416/183 |
| 1,983,201 | 12/1934 | Van Rijswijk | 416/186 R |
| 2,401,206 | 5/1946 | Van Rijswijk | 29/156.8 CF X |
| 2,784,936 | 3/1957 | Schmidt | 29/156.8 CF X |
| 2,807,871 | 10/1957 | Wagner et al. | 29/156.8 CF |
| 3,294,027 | 12/1966 | Denis | 416/213 R |
| 3,521,973 | 7/1970 | Schouw | 416/185 |
| 3,797,965 | 3/1974 | Tonooka et al. | 416/213 R |
| 3,893,817 | 7/1975 | Hackbarth | 416/183 X |
| 4,285,635 | 8/1981 | Leskinen et al. | 416/185 |

FOREIGN PATENT DOCUMENTS

| | | | |
|---|---|---|---|
| 815342 | 10/1951 | Fed. Rep. of Germany | 416/183 |
| 1100223 | 2/1961 | Fed. Rep. of Germany | 416/213 R |
| 1503584 | 7/1970 | Fed. Rep. of Germany | 416/241 A |
| 1177950 | 4/1959 | France | 416/183 |
| 848562 | 9/1960 | United Kingdom | 29/156.8 CF |

*Primary Examiner*—John T. Kwon

*Attorney, Agent, or Firm*—Connolly and Hutz

[57] ABSTRACT

An impeller for a materials handling fan can be made in several different diameters utilizing a single central hub of fixed diameter. The single central hub is designed to withstand the varying stresses imposed by different impeller diameters. A circular backplate or shroudplate is welded to the hub to extend the effective diameter of the hub.

7 Claims, 1 Drawing Sheet

MATERIALS HANDLING FAN IMPELLER

BACKGROUND OF INVENTION

In a common design of pneumatic conveying systems the materials being conveyed and the conveying gas together pass through a materials handling fan located in a pneumatic conveying line between the material pick-up or feed point and the material discharge point.

Fans which only handle gases normally have impeller blades attached to a circular front and rear shroudplate. In such a fan gas passes from the inlet opening at the center of the impeller radially outwards in the constricted paths defined by the blades and the front and rear shroudplates to the periphery of the impeller where it leaves the fan casing via an exit opening.

In designing a fan handling only gases or in a materials handling fan the principal design objective is to get a specific throughput. That throughput is a function of pressure difference across the fan and volume of gas passing through the fan. These parameters, in turn, are a function of fan blade tip speed and blade width, respectively. Blade tip speed is, of course, a function of the blades' radius and rotational speed. Thus, for a given rotational speed the pressure difference across the fan can be increased by increasing the fan blade length or impeller radius. Similarly, to increase volume through the fan the width of the fan blade can be increased. Of course, as these dimensions increase the stresses on the impeller increase dramatically for the reasons described in more detail below.

The double shroud design of the previously described gas handling fan is not suitable for use as a materials handling fan because the conveyed material cannot readily pass through the constricted path defined by the blades and the front and rear shroudplates.

The problems associated with pneumatically conveying materials through a fan with a double shroudplate impeller have led to the design of materials handling fans with impellers having radial blades shroudplate. These open impellers are not as efficient as the double shrouded gas handling impellers because of the gas turbulence that takes places between the stationary fan casing and the unshrouded side or sides of the radial impeller blades. The materials handling fan impellers with one shroudplate are substantially more efficient than the impellers with no shroudplate and the single shroud design is therefore most favored and is almost always used in the larger diameter, higher rotational speed fans used in systems requiring a substantial generation of operating gas pressure.

This invention deals only with the more efficient materials handling fan impeller using a single shroudplate or backplate.

The single shroudplate radially bladed materials handling impeller design is subject to unusually high stresses near the hub on the open or materials feeding side of the impeller because of its asymmetric design. During rotation the centrifugal force acting on the impeller blades and the shroudplate causes stresses and strains in both these components. At the same rotational speed the strain on the impeller blade alone will be substantially greater than the strain on the shroudplate of equal diameter because of the constraint of the circumferential ligaments in the circular shroudplate. As a specific example the radius of a 20" radius × ⅜ thick steel disk used as a shroudplate rotated about its central axis at 3600 rpm will increase approximately 0.005 inches, whereas the radius of a 20" long × ⅜ thick radial blade rotated about one end at 3600 rpm will increase approximately .009 inches.

When a materials handling fan impeller, made up of a multiplicity of radial blades welded or otherwise affixed to a single circular shroudplate, is rotated about its central axis, the greater strain or radial growth of the radial blades as compared to the strain or radial growth of the shroudplate will cause the impeller to distort so that the impeller, when viewed from the radial blade side, will be convex with the highest stresses being present on the non-shroud side of the impeller closest to the impeller hub.

These high stress levels, compared to the stress levels in a similar sized double shroud impeller operated at the same speed, have dramatically limited the diameter and operating speed of commercial materials handling fan rotors with a single shroudplate and hence their performance capabilities.

Sophisticated designs of materials handling fan impellers of large diameters for high rotational speeds which incorporated tapered blades and back plates, large specially shaped hubs, etc., have been developed which have the materials of construction strategically located so that the large centrifugal forces present during rotation generate acceptably low and safe levels of stress. These impellers require either extensive and expensive machining in order to distribute the materials satisfactorily or, alternatively, large and expensive castings.

It would therefore be desirable if an impeller could be constructed which is basically adaptable for use with fans of varying diameters. Absent careful design of such impellers, however, high failure rates for fans of larger diameters are likely because of the inability of the impeller to withstand stress at the impeller hub.

A background patent of general interest in this area is U.S. Pat. No. 4,285,635 which discloses a centrifugal-blower impeller — not a materials handling fan — having a center part and a cicumferential outer part of lesser thickness than the center part. The outer part consists of ring segments welded to each other and the periphery of the center part to create compressive forces in the center part.

SUMMARY OF INVENTION

It is an objective of this invention to provide an improved design of an impeller for a materials handling fan which provides for strategic location of mass to insure low and safe stress levels while, because of its unique design, making it possible to manufacture the impeller at much lower cost than existing designs.

Another object of this invention is to provide an impeller design for a materials handling fan which is useable with fans of varying diameters by minor modification to the basic impeller.

In accordance with this invention, the impeller for a materials handling fan includes a hub made of cast steel or other ductile, weldable material and of fixed structure and diameter. The effective diameter of the impeller is obtained by welding a circular backplate or shroudplate to the hub. Blades mounted generally perpendicular to the backplate are welded to the hub and the backplate to provide the necessary volume and pressure through the fan.

THE DRAWINGS

DETAILED DESCRIPTION

The present invention is based upon resolution of the problems arising from failure of fan impellers because of the high stress on the front of the fan blades near the hub resulting from the centrifugal forces encountered upon rotation of the impeller. The centrifugal forces act radially along the blades. The flat blades elongate more than the shroudplate or-backplate causing maximum stress in the hub close to the transition between the central bore and the blades. The invention is based upon a recognition of that problem with the solution being to design the hub of the impeller so that it can handle the stresses associated with impellers of various radii. Thus, it is possible to use a single hub for many fan sizes without the expense of having to use a different casting for each of the different impeller sizes. The impeller design is completed by shroudplates and blade extensions welded to the hub.

Figure 1:
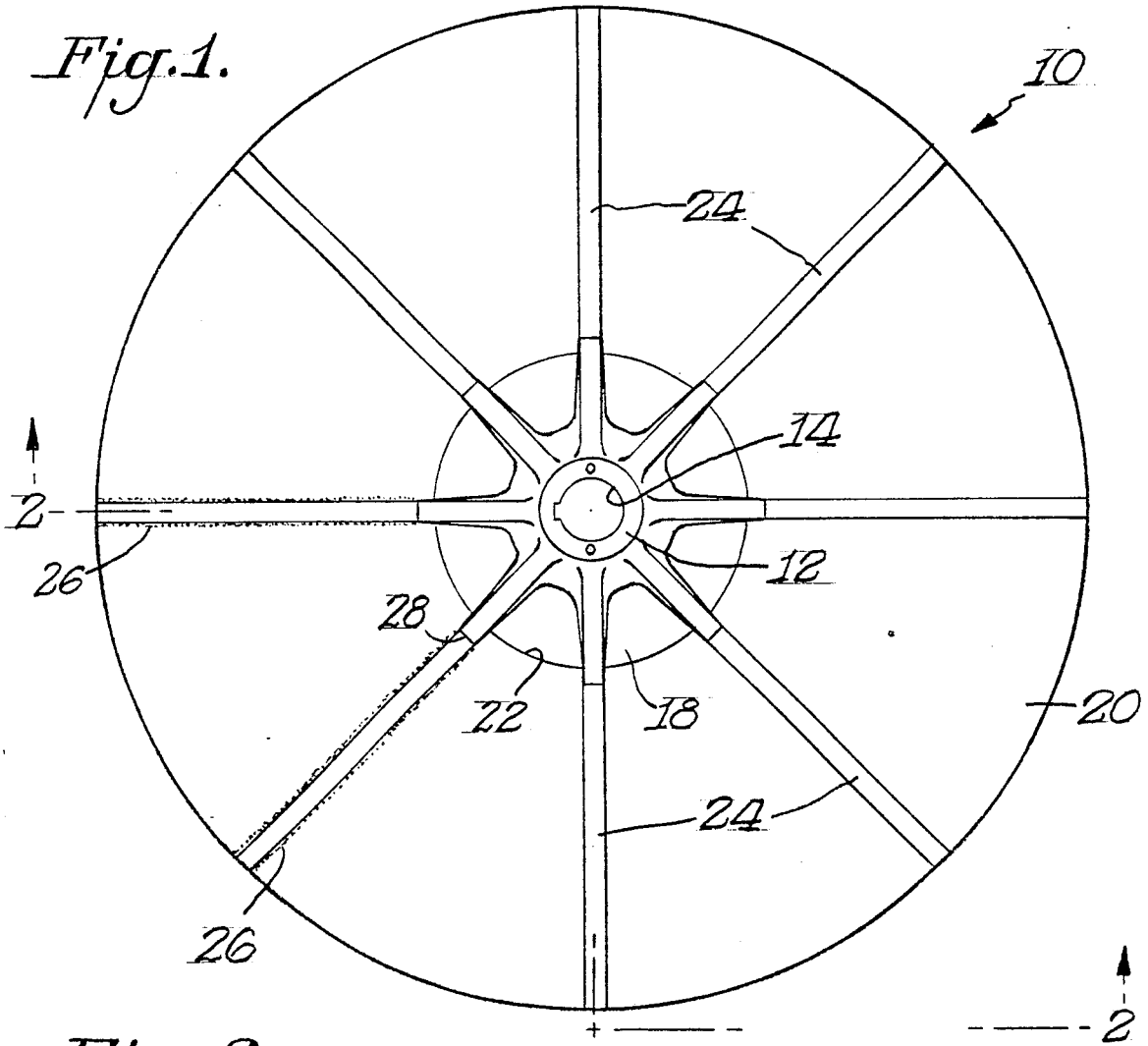
FIG. 1 is a top plan view of an impeller in accordance with this invention.
Figure 2:
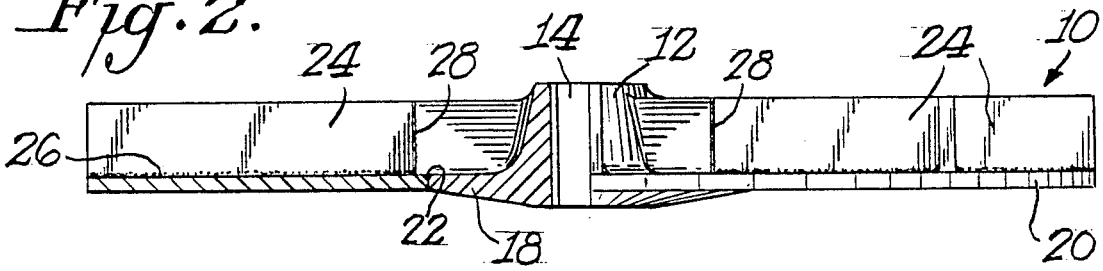
FIG. 2 is a cross-sectional view taken through FIG. 1 along the line 2—2.
Figure 3:
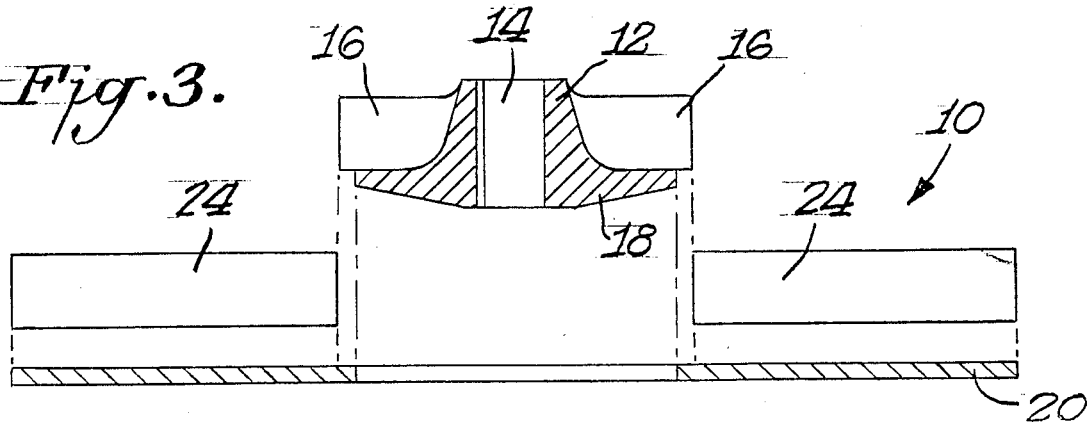
FIG. 3 is a cross-sectional assembly view of the impeller shown in FIG. 1.

As shown in FIGS. 1–3 the invention utilizes an impeller 10 having a central hub 12. Hub 12 can be made of cast steel with low carbon content having a Young's Modulus of about 30,000,000 psi and tensile strength of about 70,000 psi or other weldable materials with suitable properties. As best seen in FIG. 3 hub 12 includes an axial bore 14 and keyway as is conventionally known in the art so that a drive shaft may be mounted in bore 14. Hub 12 also includes upstanding blades 16 and web 18. Blades 16 are equally spaced radial blades which extend beyond the periphery of web 18. As the straight rectangular blades 16 approach the center of the hub 12 the blades thicken and transition into the circular, center portion of hub 12. This design provides more metal at critical stress areas on the portion of the blades closest to the hub and facilitates use of a single hub to be used for impellers of varying radii.

In accordance with the invention, hub 12 is made in one size useable with a multiplicity of impeller sizes. Typically, hub 12 would have a diameter at its web of about 13 inches which could be used with impeller fans ranging in diameter from 30 to 40 inches.

The diameter of the impeller is varied by securing to hub 12 an annular shroudplate or backplate made of any suitable material such as wrought or plate steel. Backplate or shroudplate 20 may be welded to web 18 of hub 12 at the welding seam 22 in FIG. 2 and would support the blades 24 extending from blades 16 on hub 12. Backplate or shroudplate 20 forms a contiguous, uniform extension of web 18.

In order to provide the fan function a plurality of upright rectangular blade extensions 24 are added to the hub-shroudplate assembly by weldments along their bottom edge as indicated by the reference numeral 26 in FIG. 2. Blade extensions 24 are also welded along their inner edges to blades 16 on hub 12 as indicated by the reference numeral 28 in FIG. 2. Typically, blade extensions 24 can be fabricated from rectangular plate stock dimensionally corresponding to the cross section of the outer edge of blades 16 on hub 12. The resultant assembly is an impeller having blades formed by hub blades 16 and extensions 24 and a shroudplate or backplate formed by hub web 18 and backplate 20. The central hub 12 itself can be made thickened wherever deemed necessary to better resist stress as later discussed.

A particularly distinctive advantage of the invention is its maximization of efficiency by being better able to withstand stress. This is accomplished because the impeller of the invention takes into account that failure of prior art impellers frequently resulted from the tremendous stress on the front of the blades near the hub. With the impeller of this invention, the stress is distributed so that most of the stress is in the thickened hub area. The impeller of this invention is able to withstand the encountered stress because of its thickened central hub and rigidized outer structure.

The resultant impeller structure also reduces the cost of materials handling fans. By using a single hub of cast steel or other weldable materials with suitable properties to which is welded a shroudplate or backplate and blade extensions it is possible to save the considerable cost involved in machining a large, unitary fan impeller. Although hub 12 is only, for example, 13 inches in diameter the addition of a shroudplate or backplate 20 and blade extensions 24 permits the effective impeller diameter to be such that it may be used for fans in excess of 14 inches in diameter up to, for example, 40 inches in diameter. The manufacturer would thus find it necessary to simply stock a single size hub and a variety of backplates or shroudplates and blade extensions. A further advantage of the invention is that it lends itself to better quality control since it is easier to control the quality of small pieces, such as the standardized hub than would be required for larger size impellers as in the prior art. Accordingly, in the practice of the invention the hub which represents the most costly part of the impeller could be made of standardized universal construction adaptable for fans of a great variety of diameters.

What is claimed is:

1. In a materials handling fan, an impeller comprising a central thickened hub, said hub including an axial bore for receiving a drive shaft therein, a web section perpendicular to said bore, and a plurality of blades mounted perpendicular to said web and radially extending from said hub, an annular backplate distinct from and secured to the periphery of said web to extend the effective diameter of the assembly and a plurality of blade extensions secured to the backplate and to the hub blades.

2. The fan of claim 1 wherein each of the hub blades has one of the blade extensions secured thereto.

3. The fan of claim 2 wherein the backplate is dimensioned to provide a contiguous uniform extension of said web.

4. The fan of claim 3 wherein each of the blade extensions is dimensioned to provide a contiguous, uniform extension of a hub blade.

5. The fan of claim 4 wherein the materials inlet side of the hub is frusto-conically shaped, the backplate is secured to said web by welding and the blade extensions are secured to the backplate and to the hub blades by welding.

6. The fan of claim 5 wherein the web has a diameter less than 14 inches, and the backplate has an outside diameter of at least 14 inches.

7. The fan of claim 4 wherein the hub blades extend outwardly beyond said web, and the backplate is secured to the hub blades.

* * * * *

UNITED STATES PATENT AND TRADEMARK OFFICE

CERTIFICATE OF CORRECTION

PATENT NO. : 4,958,987

DATED : September 25, 1990

INVENTOR(S) : John G. S. Billingsley

It is certified that error appears in the above-identified patent and that said Letters Patent is hereby corrected as shown below:

Column 1, lines 40, after "blades" insert --and one or no--;

Column 4, lines 62-64, delete Claim 6 and substitute the following Claim 6.

--6. The fan of Claim 5 wherein the hub blades extend outwardly beyond said web, and the backplate supports the portion of the hub blades extending beyond said web.--

Signed and Sealed this

Twenty-third Day of March, 1993

*Attest:*

STEPHEN G. KUNIN

*Attesting Officer*

*Acting Commissioner of Patents and Trademarks*